US009381478B2

(12) United States Patent
Firestone

(10) Patent No.: US 9,381,478 B2
(45) Date of Patent: Jul. 5, 2016

(54) ROTARY IMPELLER FOR MIXING AND GRINDING MATERIALS

(71) Applicant: Norstone, Inc., Bridgeport, PA (US)

(72) Inventor: Daniyel Firestone, Plymouth Meeting, PA (US)

(73) Assignee: Daniyel Firestone, Plymouth Meeting, PA (US)

( * ) Notice: Subject to any disclaimer, the term of this patent is extended or adjusted under 35 U.S.C. 154(b) by 0 days.

(21) Appl. No.: 14/801,169

(22) Filed: Jul. 16, 2015

(65) Prior Publication Data

US 2016/0030902 A1 Feb. 4, 2016

Related U.S. Application Data

(60) Provisional application No. 62/032,712, filed on Aug. 4, 2014.

(51) Int. Cl.

| | |
|---|---|
| ***B01F 7/26*** | (2006.01) |
| ***B01F 3/12*** | (2006.01) |
| ***F04D 29/22*** | (2006.01) |
| ***B02C 18/18*** | (2006.01) |
| ***B01F 7/00*** | (2006.01) |
| ***B02C 1/00*** | (2006.01) |

(52) U.S. Cl.

CPC ..... *B01F 3/1221* (2013.01); *B01F 7/00466* (2013.01); *B01F 7/26* (2013.01); *B02C 1/00* (2013.01); *B02C 18/182* (2013.01); *F04D 29/2288* (2013.01)

(58) Field of Classification Search

CPC ..... B01F 7/00466; B01F 7/0045; B01F 7/10; B01F 7/26; B02C 18/083; B02C 18/182

USPC ..... 366/315–317; 241/93, 191, 293, 296, 241/297; 416/228, 231 A, 231 R, 231 B, 416/241 A

See application file for complete search history.

(56) References Cited

U.S. PATENT DOCUMENTS

| | | | | | |
|---|---|---|---|---|---|
| 2,115,997 | A * | 5/1938 | Morse | B03D 1/16 | 209/169 |
| 3,100,628 | A * | 8/1963 | Norris, Jr. | B01F 7/0045 | 366/317 |
| 3,630,373 | A * | 12/1971 | Grazen | B01D 35/26 | 210/416.1 |
| 4,171,166 | A * | 10/1979 | Trowbridge | B01F 7/0045 | 366/316 |
| 5,201,635 | A * | 4/1993 | Steinmetz | B01F 7/00016 | 366/316 |
| 5,292,193 | A * | 3/1994 | Funk | B01F 7/00466 | 241/162 |

(Continued)

FOREIGN PATENT DOCUMENTS

| | | | | |
|---|---|---|---|---|
| GB | 2194166 | A * | 3/1988 | B01F 7/00908 |

*Primary Examiner* — Charles Cooley
(74) *Attorney, Agent, or Firm* — Howson & Howson LLP

(57) ABSTRACT

A rotary impeller having a solid disk-shaped body with a center bore, a first major face, an opposed major face, and an outer peripheral side edge face that is circular in plan and that extends along an outer diameter of the body is provided. A plurality of separate, circumferentially-spaced apart, radially-extending grooves are formed in the first major face, and each of the grooves extends through the outer peripheral side edge face and is of a depth that terminates a spaced distance from the opposed major face of the disk-shaped body such that the grooves do not extend fully through the disk-shaped body. An array of separate, upstanding, circumferentially-spaced teeth project from the first major face adjacent the grooves along the outer peripheral side edge face of the disk-shaped body.

9 Claims, 3 Drawing Sheets

(56) References Cited

U.S. PATENT DOCUMENTS 5,409,313 A * 4/1995 Funk ..... B01F 7/00466 241/162
5,797,728 A * 8/1998 Frith ..... F04D 29/2288 366/316
5,888,440 A 3/1999 Steinmetz
8,028,944 B2 10/2011 Firestone
2006/0233044 A1 * 10/2006 Freeman ..... B01F 7/26 366/316
2016/0030902 A1 * 2/2016 Firestone ..... B01F 7/00466

* cited by examiner

FIG. 1
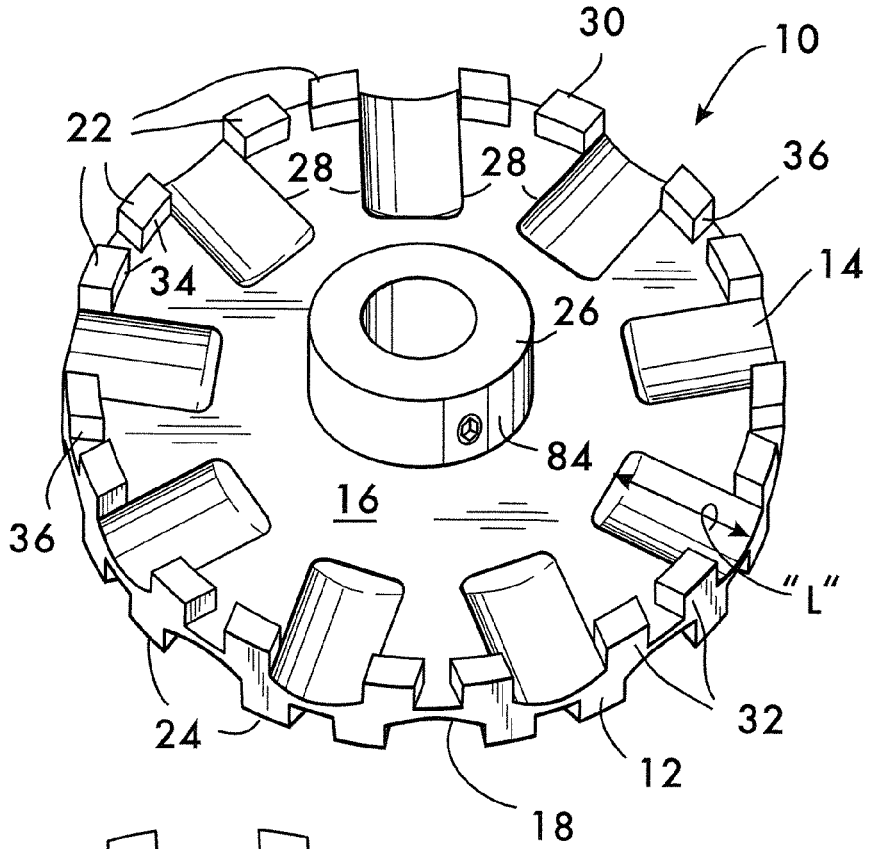
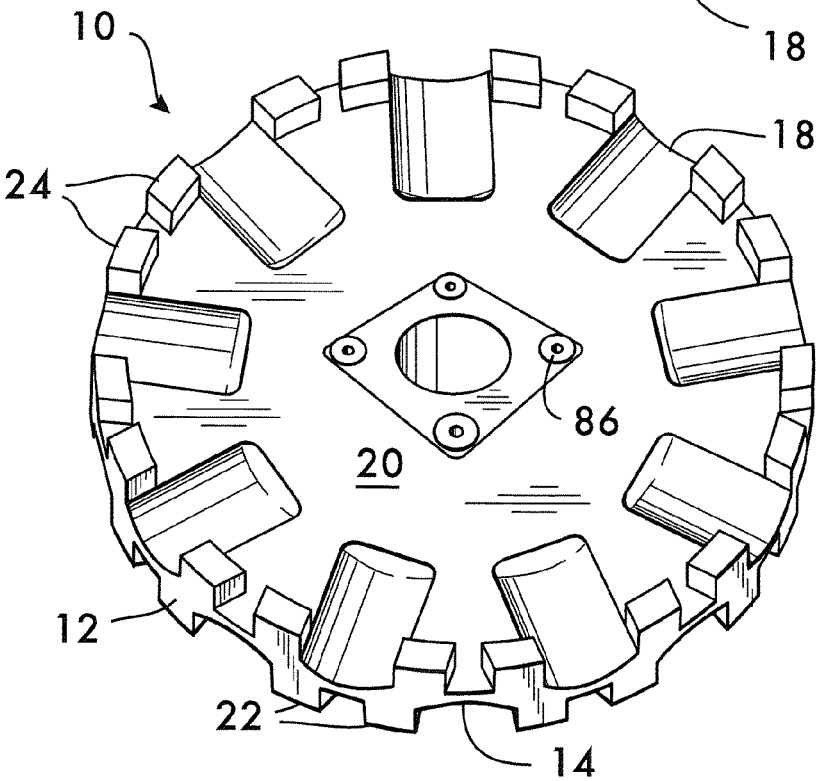
FIG. 2

ROTARY IMPELLER FOR MIXING AND GRINDING MATERIALS

CROSS-REFERENCE TO RELATED APPLICATION

This application claims the benefit under 35 USC §119(e) of U.S. Provisional Patent Application No. 62/032,712 filed Aug. 4, 2014.

BACKGROUND

A rotary blade or impeller for mixing fluent, particulate, slurry, semi-liquid, or liquid materials is disclosed. More particularly, a rotary impeller is disclosed that is specifically adapted for mixing materials that contain agglomerates or other clumped masses of a type that necessarily requires relatively high shear and cutting action to enable grinding and breaking apart of the agglomerates and dissemination and dispersion thereof within a mixture.

Rotary impellers are known for use in a wide variety of industrial mixing applications to mix particulate materials, slurries and the like having various characteristics by creating turbulent flow of fluent material within a vessel when the impeller is rotated by a rotatable shaft of a mixing apparatus. Rotary impellers may also be used in an attempt to finely grind and break apart solid materials and/or agglomerates of materials that may or may not be suspended within a carrier material or fluid and to evenly disperse the solid material or agglomerates within the carrier material. Typically, the ability of the impeller to finely grind solid particles or agglomerates to a desired reduced size and to evenly disperse these particles throughout the carrier material is important toward the effectiveness of a final mixture. Thus, failure to provide a homogeneous final mixture can compromise the integrity of the product formed by the mixture and may prevent the product from functioning properly. Impeller imparts shear and collisions of particles causing particles to break apart.

Some mixing applications include grinding of particulate materials, powders, or slurries containing agglomerates that are particularly difficult to break apart and reduce in size and evenly disperse within a material. Such materials may include, for instance, high viscosity slurries and carrier materials having relatively hard and dense agglomerates and solid particles suspended therein. A blade or impeller for applications involving such materials is desired.

BRIEF DESCRIPTION OF THE DRAWINGS

FIG. 1 is a perspective view of a first embodiment of a rotary impeller according to the present invention.

FIG. 2 is a perspective view of the underside of the rotary impeller of FIG. 1.

DETAILED DESCRIPTION

Figure 3:
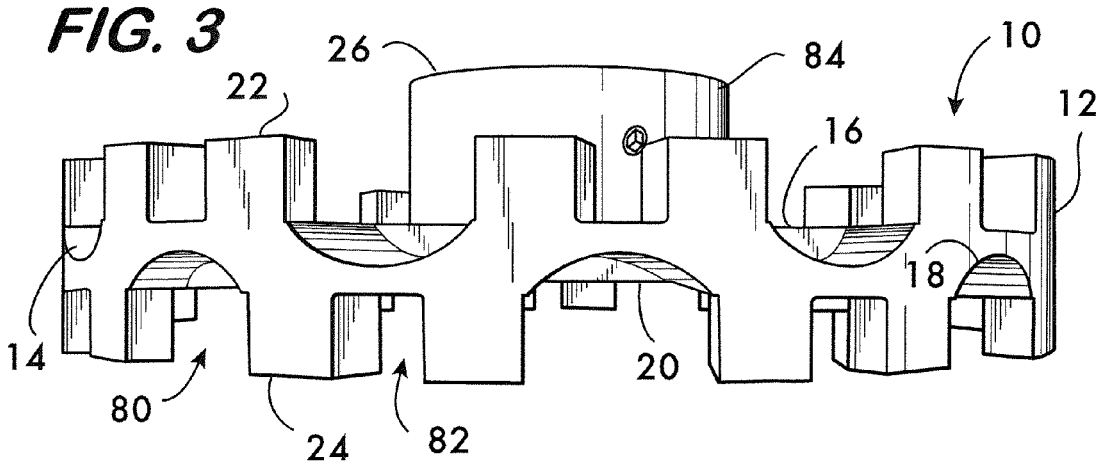
FIG. 3 is an elevational view of the rotary impeller of FIG. 1.

An impeller is provided which, in use, is disposed and mounted on a rotating shaft of mixing apparatus and immersed within a material to be subject to mixing and/or grinding. According to an embodiment, the impeller has a substantially disk-shaped body with a generally-circular outer diameter. The body has a thickness, opposite major faces, a peripheral side face, and a central bore. The thickness of the body is essentially constant and uniform and the major faces are essentially planar, except for the existence of a series of grooves and teeth discussed in detail below.

Several, separate, radially-extending, spaced-apart grooves or so-called "scoops" are formed in one or both of the major faces of the disk-shaped body such that the grooves or scoops extend through and appear in the outer peripheral side edge or face of the body. The grooves or scoops may be provided in the form of shallow recesses that do not extend through the full thickness of the disk-shaped body. Thus, at the locations of the grooves, recesses, or scoops, the thickness of the disk-shaped body is reduced as compared to other locations. By way of example, each groove may only extend through approximately half the full thickness of the disk-shaped body. Of course, each groove could extend through more or less of the full thickness of the body provided not entirely through the full thickness of the body.

Each groove may have a curved profile in transverse cross-section, such as when viewed from the side edge or face of the disk-shaped body. When grooves are formed in both major faces of the body, the same number and size of grooves may be provided on both major faces such that both major faces are of a substantially identical configuration. However, the grooves formed in one of the major faces may be circumferentially offset with respect to the grooves formed in the opposite major face such that, upon viewing the body from the side edge or face, a groove on one major face may be spaced between two adjacent grooves on the opposite major face.

According to an embodiment, the impeller is specifically adapted to mix and break-up settled powder and grind difficult to disperse agglomerates that may require both high shear and cutting action for proper agglomerate size reduction and even dispersion of the agglomerates within a mixture. For this purpose, the impeller includes a plurality of separate tooth-like protrusions projecting outward from one or both of the major faces of the body. The protrusions may be located adjacent the outer diameter of the disk-shaped body and be circumferentially-spaced apart along the outer edge thereby aiding in defining the surface shape and appearance of the side edge or face of the body. The protrusions may also be located at locations spaced from the outer diameter of the body.

When the disk-shaped impeller body is rotated, the set of teeth or projections work in concert with the grooves, recesses, or scoops to finely grind solid material, particles, and agglomerates and improve turbulent flow of the material being mixed. This ultimately improves the efficiency of finely grinding, breaking up, and evenly dispersing the solid particles and agglomerates within the mixture. In particular, the teeth are provided to create an aggressive cutting action during vortex formation of the carrier material, slurry, or fluid. The teeth also enable the size of powder type materials and agglomerates to be greatly reduced as compared to other impeller configurations and designs.

Further, the number and size of teeth on the disk-shaped impeller body can be provided for temperature control purposes such that, as the impeller body is rotated, the set of teeth or projections enable the amount of heat generated within a batch of material being mixed to be precisely controlled. For instance, the more teeth added to the impeller body, the greater the heat generated within a material being mixed as a result of greater energy input. Embodiments of the impeller blade have been found to be able to run significantly cooler batches as compared to when a conventional steel blade is utilized. Also, embodiments of the impeller blade have been found to build heat within a batch of material being mixed much quicker than conventional impellers. In this manner, the number of teeth can be particular selected based on the particular temperature control needs of an end user depending upon whether the end user seeks the impeller blade to run relatively hot or cold with respect to the generation of heat within a batch of a material being mixed.

The number of teeth and/or scoops on a face of the disk-shaped body may be varied depending upon the material being ground, broken apart, and dispersed. The placement of the teeth and/or scoops on the face of the disk-shaped body may also be varied and may be provided on only one of the faces or both of the faces of the disk-shaped impeller body. In use, the impeller may be used alone as a single mixing blade or may be used with other like impellers mounted in a series above or below each other or next or adjacent to each other within a mixing vessel.

The impeller body may be made from polymers, metal, ceramics or other materials. According to one example of an embodiment, the impeller body is molded or fabricated such that the teeth are integrally formed on the impeller body. For example, the impeller body, including the teeth, may be molded of urethane, polyurethane, polyethylene, Ultra High Molecular Weight (UHMW) polyethylene, Polytetrafluoroethylene (PTFE), polypropylene, nylon, or the like. According to another embodiment, the impeller body may include a dynamically balanced metal plate embedded therein, such as a steel plate. As yet another alternative, the impeller body may be fabricated of a ceramic or metallic material.

The impeller body having the teeth and scoops discussed above may be mounted on a rotating shaft of a mixing machine by a wide variety of means including keyways, bolt holes, hubs and couplings.

One contemplated embodiment of an impeller body 10, referenced as a first embodiment herein, is shown in FIGS. 1-3. The impeller body 10 may be molded or fabricated of a polymeric material such as urethane, polyurethane, polyethylene, Polytetrafluoroethylene (PTFE), polypropylene, or nylon. By way of example, the impeller body 10 may be molded of polyurethane having a hardness of above 90 Shore A durometer or a hardness that may be at or about 75 Shore D durometer. The hardness of the polyurethane may be selected based upon the type of material being admixed. A higher or lower durometer may be used.

The impeller body 10 may be disc shaped having a central bore about which a separately manufactured hub 26 may be secured. The disc-shaped impeller body 10 includes an outer peripheral side edge face 12 defined by a predetermined outer diameter of the body 10. The dimension of the outer diameter may be provided based on the mixing apparatus or material to be mixed. By way of example, the outer diameter of the impeller body 10 may be, for instance, between 3 inches and 32 inches. As a specific example, the body may have an outer diameter of 7, 8 or 9 inches. However, one of ordinary skill in the art will appreciate that the impeller body may be of any diameter and may even be produced of non-circular configurations as may be required for a particular application.

As shown in FIG. 1, the impeller body 10 includes a plurality of separate, elongate, radially-extending, circumferentially-spaced grooves, recesses, or scoops 14 formed on a major face 16 of the body 10. The body 10 also includes a plurality of separate, elongate, radially-extending, circumferentially-spaced grooves, recesses, or scoops 18 on an opposing major face 20 (i.e., the underside as shown in FIG. 2) of the body 10.

The grooves 14 and 18 are each evenly spaced apart about the circumference of the body 10 and are located adjacent the outer-peripheral side edge face 12. The grooves 14 on the face 16 and the grooves 18 on the opposing face 20 are circumferentially offset such that the grooves on one face are equally spaced between the grooves on the other face and are not directly opposed. In addition, the grooves 14 and 18 are provided in the form of recesses that do not extend through the entire thickness of the body 10, but do extend into the outer peripheral side edge face 12. For instance, see FIG. 3.

In the first embodiment as shown in FIG. 1, the length "L" of each groove 14 may be approximately one-third of the radius of the body 10. However, the length may be larger or smaller, such as 10% to 50% of the radius of the body 10. In plan, each groove 14 has a substantially rectangular footprint (see FIGS. 1 and 2) and, in transverse cross-section, the recess provided by each groove 14 has a cupped, curved or U-shape (see FIG. 3), for instance, formed at a radius of curvature. In addition, each of the grooves 14 and 18 are of a uniform width, length, and depth such that the outer peripheral side edges 28 of the grooves 14 and 18 do not taper toward the center of the disk (i.e., the opposite side edges 28 of the grooves 14 and 18 along the length of the grooves are substantially parallel). For instance, see FIGS. 1 and 2.

There may be any number of grooves per face including even or odd grooves per face. For instance, in FIG. 1, there are nine grooves 14 and 18 on each major face, 16 and 20. However, this merely provides an example of one contemplated embodiment and other embodiments may have more or less grooves. According to some embodiments, the number of grooves is a function of three (i.e., three, six, nine, twelve, etc. number of grooves on each face). The number of grooves 14 and 18 may be selected as a function of the viscosity of the intended slurry and/or the properties of the solid particles or agglomerates being broken up and mixed. To this end, more grooves may be used for more viscous fluids and/or particles or agglomerates with properties making them more difficult to grind or break apart. One of ordinary skill in the art will appreciate that the dimensions of each groove is also dependent upon the properties of the solid particles, agglomerates, and carrier being mixed.

The impeller body 10 shown in FIG. 1 also includes a plurality of teeth 22 projecting from the major face 16 and a plurality of teeth 24 projecting from the major face 20. Each of the teeth 22 and 24 is provided by a solid outward projection formed along and adjacent the outer peripheral side edge face 12 of the body 10. The teeth 22 and 24 may be a uniform size and shape. In the embodiment shown in FIG. 1, the teeth 22 and 24 do not extend into, within, or through the grooves 14 and 18; rather, teeth 22 and 24 closely flank either side of each groove 14 and 18. Thus, in the illustrated embodiment, each groove is associated with a complementary pair of adjacent teeth. Accordingly, since the embodiment of FIG. 1 includes nine grooves on each face of the body 10, each face of the body 10 will include eighteen teeth (two per groove). As stated above, the number of grooves as well as the number and placement of teeth may be varied in other embodiments (for instance, see the second and third embodiments shown in FIGS. 4-7).

Simply for purposes of example, each groove and teeth pairing may include two separate teeth spaced apart by the width of the groove. In other contemplated embodiments, there may be more or less teeth and more or less grooves and the spacing therebetween may differ. In the embodiment illustrated in FIGS. 1-3, each groove and teeth pairing is spaced from the adjacent groove and teeth pairing such that a tooth of one of the pairings is spaced from a tooth of an adjacent pairing. Thus, the pattern about the outer peripheral side edge face 12 of the body 10 along one of the major faces is tooth-groove-tooth-tooth-groove-tooth-tooth-groove-tooth, etc. Of course, this pattern of teeth and grooves merely provides one example and other patterns may be utilized.

In the first embodiment, the width of each tooth is generally half the width of each groove, and the spacing between teeth that are not separated by a groove along the outer peripheral side edge face 12 of the body 10 is about the same as the width of each tooth. Thus, each tooth is separate and individual and does not contact other teeth or extend within a groove. Some contemplated embodiments may not utilize the above relationships between tooth and groove sizing and spacing.

In the first embodiment, the height of each of the teeth is generally slightly greater than the thickness of the body 10 where no groove is located, and each of the teeth extends along approximately one-fourth of the length of each groove. As stated above, some contemplated embodiments may not utilize the above relationships with respect to the height and length of each tooth relative to the depth and length of each groove. For example, the shape and size of the teeth may be selected based on the viscosity or type of solid particles or agglomerates to be subject to mixing. For example, a greater number and size of teeth may be used for more viscous fluids and/or more abrasive particles or agglomerates having properties making them more difficult to grind.

Merely for purposes of example, each tooth may have a substantially box-like configuration having a planar top surface 30 with four corners closely resembling a rectangle, for instance, as shown in FIG. 1. Alternatively, each tooth could be angled, rounded, or resemble other shapes, such as a trapezoid shape shown in FIGS. 4 and 6.

In the first embodiment, one of the vertical sides 32 of each tooth forms a surface of the outer peripheral edge face 12; thus, this vertical side 32 of the tooth is necessarily slightly arcuate following the contour dictated by the outer diameter of the disk-shaped body 10. The opposite or inner vertical side 34 of each tooth is also formed along a diameter that is spaced inward of the outer diameter. As an alternative, the sides of the teeth may be formed irrespective of the outer diameter. The length of each tooth between the outer vertical side 32 and opposite inner vertical side 34 may be substantially constant and uniform. The end vertical side faces 36 of each tooth may be planar and parallel to each other. Thus, each tooth may define four sharp vertically-extending corner edges extending from the body 10 to the planar top surface 30. However, as stated above, the shape of the teeth may be varied and include a rounded top and/or rounded corners.

Figure 5:
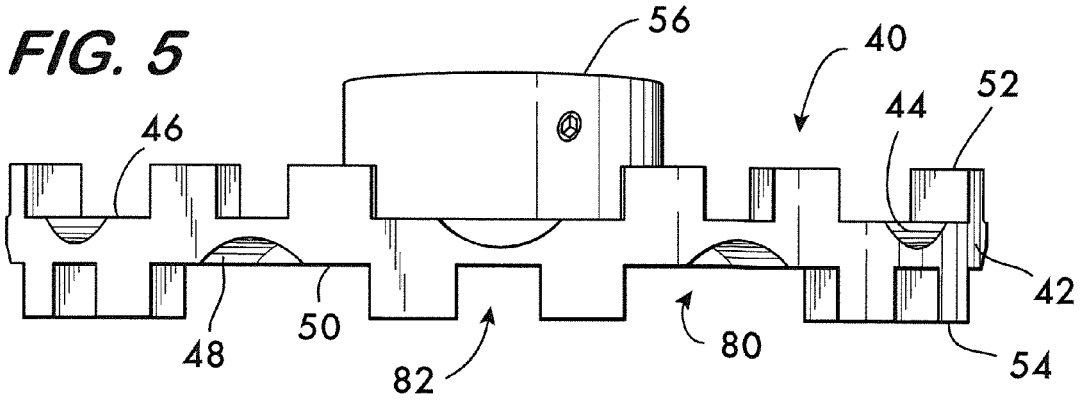
FIG. 5 is an elevational view of the rotary impeller of FIG. 4.
Figure 4:
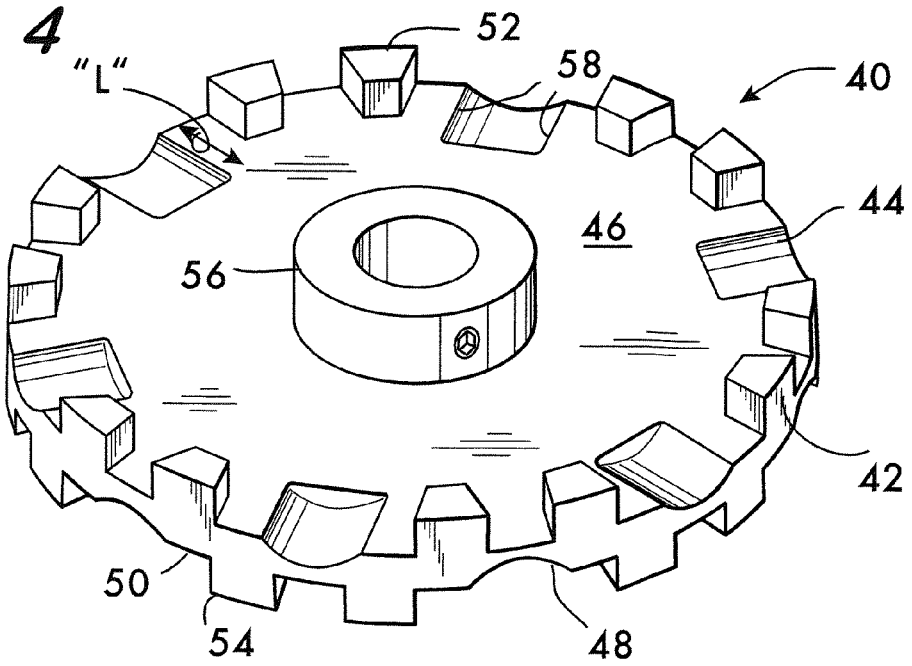
FIG. 4 is a perspective view of a second embodiment of a rotary impeller according to the present invention.

A second embodiment of an impeller body 40 is shown in FIGS. 4 and 5. Impeller body 40 is similar in many aspects to impeller body 10 discussed above. For instance, the impeller body 10 may be generally disc-shaped and may be molded or fabricated of a polymeric material and may have a central bore about which a separately manufactured hub 56 may be attached. In addition, the body 40 includes an outer peripheral side edge face 42 defining a predetermined outer diameter of the body 40. The dimension of the outer diameter may be provided based on the mixing apparatus or material to be mixed. By way of example, the outer diameter of the impeller body 40 may be about 8 inches. However, one of ordinary skill in the art will appreciate that the impeller body may be of any diameter or of non-circular configurations.

As shown in FIG. 4, the impeller body 40 includes a plurality of separate, elongate, radially-extending, circumferentially-spaced grooves, recesses, or scoops 44 formed on a major face 46 of the body 40. The body 40 also includes a plurality of separate, elongate, radially-extending, circumferentially-spaced grooves, recesses, or scoops 48 on an opposing major face 50 (i.e., the underside) of the body 40. The grooves 44 and 48 are each evenly spaced apart about the circumference of the body 40 and are located adjacent the outer-peripheral side edge face 42. The grooves 44 on the face 46 and the grooves 48 on the opposing face 50 are circumferentially offset such that the grooves on one face are equally spaced between the grooves on the other face and are not directly opposed. In addition, the grooves 44 and 48 are provided in the form of recesses that do not extend through the entire thickness of the body 40, but do extend into the outer peripheral side edge face 42. For instance, see FIG. 5.

In the second embodiment as shown in FIG. 4, the length "L" of each groove 44 is approximately one-eighth of the radius of the body 40. However, the length may be larger or smaller, such as 10% to 50% of the radius of the body 40. In plan, each groove 44 has a substantially rectangular footprint (see FIG. 4) and, in transvers cross-section, the recess provided by each groove 44 has a cupped, curved or U-shape (see FIG. 5). By way of example, each groove may be formed at a radius of curvature of about 0.68 inch. In addition, each of the grooves 44 and 48 are of a uniform width, length, and depth such that the outer peripheral side edges 58 of the grooves 44 and 48 do not taper toward the center of the disk (i.e., the opposite side edges 58 of the grooves 44 and 48 along the length of the grooves are substantially parallel). For instance, see FIG. 4.

The impeller body 40 has six grooves 44 and 48 on each major face, 46 and 50. However, this merely provides an example of one contemplated embodiment and other embodiments may have more or less grooves. The impeller body 40 includes a plurality of teeth 52 projecting from the major face 46 and a plurality of teeth 54 projecting from the major face 50. Each of the teeth 52 and 54 is provided by a solid outward projection formed along and adjacent the outer peripheral side edge face 42 of the body 40. The teeth 52 and 54 may be a uniform size and shape. As shown in FIGS. 4 and 5, the teeth 52 and 54 do not extend into, within, or through the grooves 44 and 48; rather, teeth 52 and 54 are spaced from either side of each groove 44 and 48. Thus, in the illustrated embodiment, each groove is associated with a complementary pair of adjacent teeth. Accordingly, since the embodiment of FIG. 4 includes six grooves on each face of the body 40, each face of the body 40 has twelve teeth (two per groove). As stated above, the number of grooves as well as the number and placement of teeth may be varied in other embodiments (for instance, see the third embodiment shown in FIGS. 6-7 that has three teeth between each pair of adjacent grooves).

In the second embodiment, the width of each tooth is generally half the width of each groove, and the spacing between teeth that are not separated by a groove along the outer peripheral side edge face 42 of the body 40 is about the same as the width of each tooth. Thus, each tooth is separate and individual and does not contact other teeth or extend within a groove. Each of the teeth extends along approximately one-half of the length of each groove and may have a substantially trapezoidal configuration in plan view.

Figure 7:
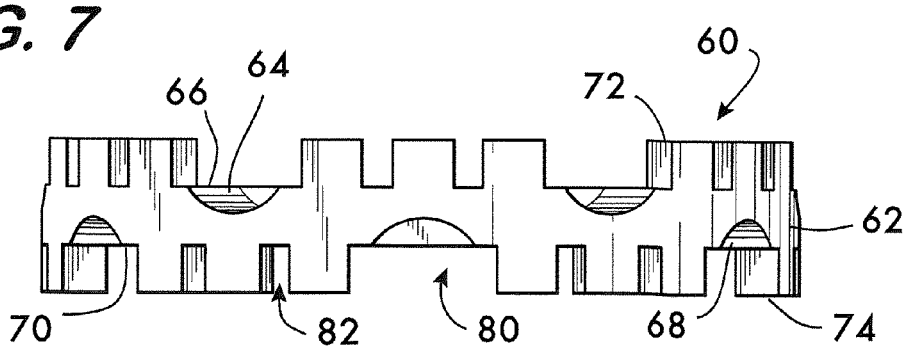
FIG. 7 is an elevational view of the rotary impeller of FIG. 6.
Figure 6:
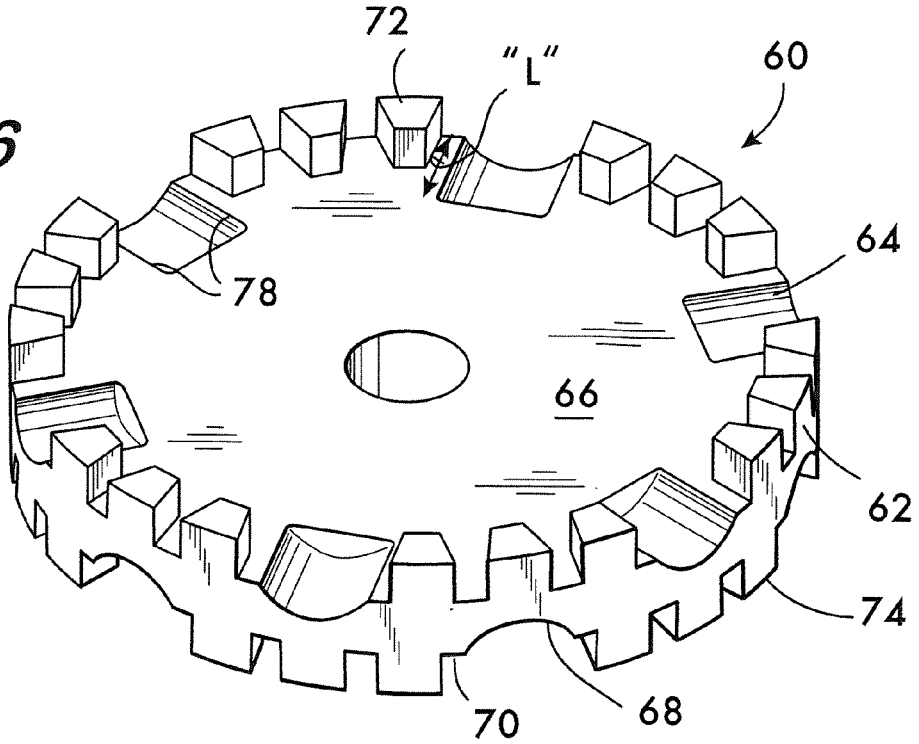
FIG. 6 is a perspective view of a third embodiment of a rotary impeller according to the present invention.

FIGS. 6 and 7 show a third embodiment of an impeller body 60 that is similar in some aspects to impeller body 10 discussed above. For instance, the impeller body 60 may be molded or fabricated of a polymeric material and may have a central bore about which a hub (not shown in FIGS. 6 and 7) may be attached. The body 60 includes an outer peripheral side edge face 62 defining a predetermined outer diameter of the body 60. The dimension of the outer diameter may be provided based on the mixing apparatus or material to be mixed. By way of example, the outer diameter of the impeller body 60 may be about 7 inches. However, one of ordinary skill in the art will appreciate that the impeller body may be of any diameter or of non-circular configurations.

As shown in FIG. 6, the impeller body 60 includes a plurality of separate, elongate, radially-extending, circumferentially-spaced grooves, recesses, or scoops 64 formed on a major face 66 of the body 60. The body 60 also includes a plurality of separate, elongate, radially-extending, circumferentially-spaced grooves, recesses, or scoops 68 on an opposing major face 70 (i.e., the underside) of the body 60. The grooves 64 and 68 are each evenly spaced apart about the circumference of the body 60 and are located adjacent the outer-peripheral side edge face 62. The grooves 64 on the face 66 and the grooves 68 on the opposing face 70 are circumferentially offset such that the grooves on one face are equally spaced between the grooves on the other face and are not directly opposed. In addition, the grooves 64 and 68 are provided in the form of recesses that do not extend through the entire thickness of the body 60, but do extend into the outer peripheral side edge face 62. For instance, see FIG. 7.

In the third embodiment as shown in FIG. 6, the length "L" of each groove 64 is between about 10% to 50% of the radius of the body 60. In plan, each groove 64 has a substantially rectangular footprint (see FIG. 6) and, in transvers cross-section, the recess provided by each groove 64 has a cupped, curved or U-shape (see FIG. 7). By way of example, each groove may be formed at a radius of curvature of about 0.6 inch. In addition, each of the grooves 64 and 68 are of a uniform width, length, and depth such that the outer peripheral side edges 78 of the grooves 64 and 68 do not taper toward the center of the disk (i.e., the opposite side edges 78 of the grooves 64 and 68 along the length of the grooves are substantially parallel). For instance, see FIG. 6.

Body 60 has six grooves 64 and 68 on each major face, 66 and 70, and includes a plurality of teeth 72 projecting from the major face 66 and a plurality of teeth 74 projecting from the major face 70. Each of the teeth 72 and 74 is provided by a solid outward projection formed along and adjacent the outer peripheral side edge face 62 of the body 60. The teeth 72 and 74 may be a uniform size and shape. As shown in FIGS. 6 and 7, the teeth 72 and 74 do not extend into, within, or through the grooves 64 and 68; rather, teeth 72 and 74 are spaced from either side of each groove 64 and 68. As shown in FIG. 6, there are three teeth spaced between each adjacent pair of grooves. Accordingly, since the embodiment of FIG. 6 includes six grooves on each face of the body 60, each face of the body 60 has eighteen teeth (three per groove).

In the third embodiment, the spacing between teeth that are not separated by a groove along the outer peripheral side edge face 62 of the body 60 is less than (about half) the width of each tooth. Thus, each tooth is separate and individual and does not contact other teeth or extend within a groove. The teeth extend along approximately one-half of the length of each groove. Merely for purposes of example, each tooth 52 and 54 of the second embodiment may have a substantially trapezoidal configuration in plan view.

The impeller bodies 10, 40 and 60 provide examples of embodiments in which the teeth are molded or fabricated integral with the impeller body and are made of the same material as the impeller body. For instance, the body including the teeth may be molded or fabricated of polyurethane. In use, the teeth are provided to break apart and disperse solid particles or agglomerates and alter turbulent flow so as to maximize particle dispersion.

The surface, shape, and appearance of the outer peripheral side face or edge 12, 42 and 62 of the impeller bodies 10, 40 and 60 are best shown in FIGS. 3, 5 and 7 and are defined by the presence of the teeth and grooves on each major face of the bodies. As shown, on both the upper and lower sides of the bodies, the openings formed in the side face include an alternating array of relatively-large arched-shaped or U-shaped openings or channels 80 defined by a groove and adjacent teeth and relatively smaller square or rectangular openings 82 defined by an adjacent pair of teeth. This alternating array of openings/channels is identical on both sides of the impeller bodies; however, the arrays of alternating openings are offset relative to each other.

The arched-shaped openings or channels 80 are defined by a groove and teeth on adjacent sides of the groove. The opening or channel may have a consistent and uniform size along the length of each of the teeth defining the channel. Thus, the opposed vertical end side faces of each pair of teeth that are separated by a groove may be parallel. In contrast, the smaller openings 82 are formed between each pair of adjacent teeth that are not separated by a groove. The opposed vertical end faces of such teeth are not parallel and therefore may converge toward each other (see FIGS. 1 and 2) or extend away from each other (see FIGS. 4 and 6) as they extend toward the central bore of the bodies. Thus, each opening may define a channel that narrows or widens along its length from the side face to the center bore of the body between each pair of teeth. As viewed in plan, each of the channels formed between adjacent teeth is substantially trapezoidal in shape along its length. All of the above shaped channels, edges, teeth, grooves, and side face configuration enable more aggressive cutting and grinding action to be provided by the impeller body on agglomerates, particularly agglomerates otherwise difficult to reduce in size. The shape, size and pattern of each of the channels, edges, teeth, grooves, and side face configuration may be altered as needed in different embodiments.

A mounting structure used to mount the impeller bodies to a rotatable shaft (not shown) may include a hub (for instance, hub 26) comprising an annular metal collar 84 secured to the impeller body and extending through the center bore of the impeller body. In use, the collar 84 enables the body to be connected to a rotatable shaft of a mixing machine (not shown) such that the impeller body rotates when the shaft rotates. As shown in FIG. 2, fasteners 86 are used to connect the collar 84 to the impeller body 10. Of course, the rotary impeller bodies can be used with any type of mounting structure to accommodate the requirements of different shafts and machines.

When the impeller configurations discussed above are immersed within a fluent material in a vessel and rotated, the motion of the impeller sets up a vibration around the periphery of the impeller body. The alternating configurations of the grooves on the opposite faces of the impeller body induces an up and down motion of the fluent material around the periphery of the impeller, thereby, establishing a vortex. The teeth and configuration thereof and of the differently shaped channels on the edge of the impeller provide high shear and cutting action sufficient to break agglomerates and finely grind solid particles within the fluent material or slurry and alter the turbulent flow produced by the grooves.

Variations of the above described embodiments may be made without departing from the scope of the invention as defined in the appended claims.

I claim:

1. A rotary impeller, comprising:

a solid disk-shaped body having a center bore, a first major face, an opposed major face, and an outer peripheral side edge face that is circular in plan and that extends along an outer diameter of said disk-shaped body;

a plurality of separate, circumferentially-spaced apart, radially-extending grooves formed in said first major face, each of said grooves extending through the outer peripheral side edge face of said disk-shaped body and being of a depth that terminates a spaced distance from said opposed major face of the disk-shaped body such that said grooves do not extend fully through said disk-shaped body; and an array of separate, upstanding, circumferentially-spaced teeth that project from said first major face adjacent said grooves along said outer peripheral side edge face of said disk-shaped body, said array of teeth forming part of a surface of said outer peripheral side edge face of said disk-shape body;

each of said grooves having a pair of side edges that extend to said outer peripheral side edge face of said disk-shaped body and that extend along a length of the groove;

each of said teeth adjacent to one of said grooves having an end wall that extends upwardly from said first major face adjacent one of said side edges of one of said grooves such that each groove and pair of adjacent teeth form a channel extending through said outer peripheral side edge face of said disk-shaped body; and said array of teeth including adjacent teeth between which a groove does not extend and which form a channel therebetween which is smaller than said channel including one of said grooves such that said outer peripheral side edge face of said disk-shaped body includes said channels including one of said grooves and said smaller channels.

2. A rotary impeller according to claim 1, wherein each adjacent pair of teeth between which a groove does not extend has opposed end walls that converge toward or diverge away from each other as said opposed end walls extend inward of said outer peripheral side edge face of said disk-shaped body such that said channels formed therebetween are trapezoidal-shaped in plan having a wider opening at one end thereof and a smaller opening at an opposite end thereof.

3. A rotary impeller according to claim 1, wherein each of said teeth has a pair of opposed end walls that are substantially parallel to each other.

4. A rotary impeller according to claim 1, wherein each of said teeth has a planar top surface having four corners, and wherein each of said teeth has four vertically-extending corner edges.

5. A rotary impeller according to claim 1, wherein said disk-shaped rotary body including said array of teeth are integrally molded or fabricated of a polymeric material.

6. A rotary impeller according to claim 5, wherein said polymer of the polymeric material is selected from the group consisting of polyurethane, polyethylene, Ultra High Molecular Weight (UHMW) polyethylene, Polytetrafluoroethylene (PTFE), polypropylene, and nylon.

7. A rotary impeller according to claim 1, wherein said disk-shaped body is made of a metallic, ceramic or composite material.

8. A rotary impeller according to claim 1, wherein said opposed major face of said disk-shaped body includes a plurality of grooves and a plurality of teeth.

9. A rotary impeller according to claim 8, wherein said first major face and said opposed major face have an identical configuration of said grooves and said teeth, and wherein said grooves of said first major face are circumferentially offset from said grooves of said opposed major face.

* * * * *